US005522331A

United States Patent [19]

Stutznäcker

[11] Patent Number: 5,522,331

[45] Date of Patent: Jun. 4, 1996

[54] THREAD CUT-OFF MECHANISM FOR A SEWING MACHINE

[75] Inventor: Klaus Stutznäcker, Frechen, Germany

[73] Assignee: Nahmaschinenfabrik Emil Stutznacker GmbH & Co. KG, Cologne, Germany

[21] Appl. No.: 235,894

[22] Filed: May 2, 1994

[30] Foreign Application Priority Data

May 13, 1993 [DE] Germany ..... 43 15 802.1

[51] Int. Cl.[6] ..... D05B 65/02

[52] U.S. Cl. ..... 112/289; 112/295; 112/80.59

[58] Field of Search ..... 112/289, 293, 112/295, 285, 291, 292, 80.55, 80.56, 80.57, 80.59

[56] References Cited

U.S. PATENT DOCUMENTS 525,043 8/1894 Borton ..... 112/289

3,173,392 3/1965 Hedegaard ..... 112/292

4,155,318 5/1979 Yamamoto ..... 112/80.59

*Primary Examiner*—Peter Nerbun

*Attorney, Agent, or Firm*—Diller, Ramik & Wight

[57] ABSTRACT

A sewing machine carries a sewing needle which in turn carries a thread through a stitching aperture of a throat plate beneath which is located a gripper carried by a gripper shaft. The gripper is defined by a gripper neck, a gripper hook and a gripper knee joining the gripper hook and the gripper neck. Located adjacent the gripper bend is a thread-cutting blade. A cam, link and linkage system is provided for selectively driving the gripper shaft to selectively (a) move the gripper (7) a predetermined distance through which the cutting blade is inoperative and (b) move the gripper a further distance beyond the predetermined distance through which the cutting blade is operative to cut-off the thread. A stop boss is also provided adjacent the gripper bend to prevent the thread from being cut during motion of the gripper the predetermined distance.

18 Claims, 1 Drawing Sheet

THREAD CUT-OFF MECHANISM FOR A SEWING MACHINE

BACKGROUND OF THE INVENTION

The invention relates to a sewing machine or stitching machine, particularly a multi-needle, double-warp stitching machine having an upper-thread cutter.

There has been increased demand in the industry for neatly cut-off upper threads at the end of a sewing operation, particularly during the manufacture of high volume goods in order not to degrade the appearance of the finished goods because of the exposure of upper-thread cut segments of various lengths which are visible on the exterior of the finished goods. While upper-thread cutting devices are known, these devices are generally mechanically exceedingly complex and are difficult to operate.

SUMMARY OF THE INVENTION

The present invention is directed to a novel upper-thread cutter for a sewing machine or stitching machine, particularly a multi-needle, double-warp stitching machine which is simple in operation, economical in construction, and operates in a reliable fashion.

The present invention includes a gripper carried by a gripper shaft which is selectively driven to move the gripper a first determined distance at which a thread cutting-off mechanism is inoperative and a second distance beyond the latter predetermined distance at which the thread cutting-off mechanism cuts-off the thread.

In further accordance with the present invention, a stop boss is located forwardly of the thread cutting-off mechanism, as viewed in the direction of the cutting-off movement of the gripper, which prevents the thread from being cut-off when the gripper is moved through the predetermined distance.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
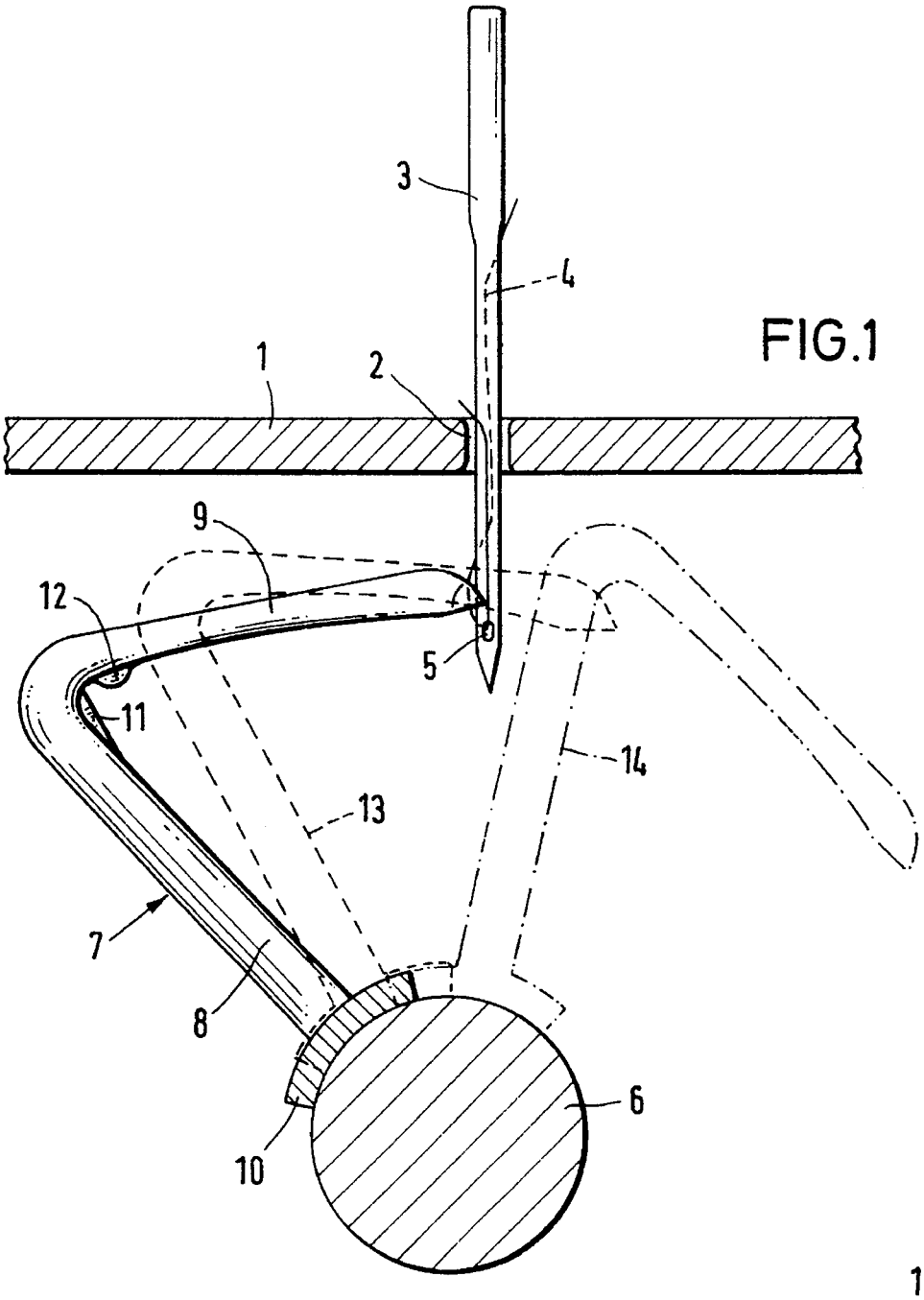
FIG. 1 is an enlarged side elevational view partially in vertical cross-section, and illustrates a gripper carried by a gripper shaft in relationship to a needle carrying an upper thread through a stitching aperture of a throat plate.

A novel improvement in a sewing machine or stitching machine in accordance with the present invention is best illustrated in FIG. 1 of the drawings and includes a throat plate 1 having a stitching aperture 2 through which passes a reciprocal sewing needle 3. The sewing needle 3 is illustrated in FIG. 1 in its lowermost position at which the upper thread 4 which is threaded through an eye 5 of the needle 3 is guided to a specific location beneath the throat plate 1 in a well known and conventional manner. Though only a single sewing needle 3 is illustrated, the invention is specifically directed to a multi-needle sewing machine or stitching machine, and such a machine has many sewing needles 5 which are mounted in series in a vertical plane and are jointly driven. A drive shaft or gripper shaft 6 is located beneath the throat plate 1 and carries a gripper 7 affixed thereto by a quick-connect/disconnect coupling 10. In the case of multi-needle sewing machines, a plurality of grippers 7 are mounted along the gripper shaft 6 in corresponding numbers to the number of the needles 3. Each gripper 7 is defined by a gripper neck 8 joined by a gripper knee or gripper bend 25 to a gripper hook 9.

Each gripper 7 includes cutting means in the form of a cutting blade 11 located substantially adjacent or contiguous the gripper bend 25. The locating of the cutting mean or cutting blade 11 is such that during rocking motion imparted to the gripper shaft to the dashed phantom outlined position 13 of FIG. 1, the upper thread 4 will not be cut, but upon further motion imparted to the gripper shaft 6 to the dash-dot phantom outlined position 14 of FIG. 1, the cutting blade 11 will cut the upper thread 4. Preferably the cutting means or cutting blade 11 is an integral portion of the gripper bend 25 which is simply ground to a sharpened edge by grinding the inside surface or inside portion (unnumbered) of the gripper bend 25. The gripper 7 is preferably constructed from hardened steel, and thus the later grinding operation to form the cutting blade 11 results in a relatively sharp cutting edge of the cutting blade 11.

Stop means in the form of a stop boss 12 having a trailing edge 26 and a leading edge 27 is also located adjacent/contiguous the gripper bend 25. The stop boss or stop means 12 is located more closely adjacent a terminal free end (unnumbered) of the gripper hook 9 than the cutting means or cutting blade 11. The purpose of the stop boss 12 is to prevent the upper thread 4 from proceeding to the cutting blade 11 during the predetermined motion of the gripper 7 to the dashed phantom outline position 13 at which it is not desired to cut the upper thread 4. However, when the gripper 7 is moved to the dot-dashed phantom outlined position 14, the upper thread 4 rides up the leading edge or surface 27 and down the trailing edge or surface 26 of the stop means 12 and is cut by the cutting means or cutting blade 11.

The operation of the thread cut-off mechanism is essentially as follows:

When the needle 3 is substantially in the lowermost position shown in FIG. 1, the upper thread 4 has formed therein a lower loop (unnumbered). The clockwise rotation of the gripper shaft 6, as indicated by the headed arrow associated therewith, similarly rotates the gripper 7 into the approximate dashed phantom outlined position 13 at which the gripper hook 9 seizes the upper-thread loop in a known manner to effect a double-warp stitch. Thus, during the predetermined distance moved by the gripper from the solid outline position of FIG. 1 to the dashed phantom line position 13 thereof, the gripper hook 9 of the gripper 7 simply operates to form a double-warped stitch in a conventional manner. However, at the end of a sewing operation when the upper thread 4 must be cut-off, the gripper shaft 6 is pivoted a further distance beyond the predetermined distance, namely, from the solid outline position shown in FIG. 1 to the dot-dashed phantom outline position 14 thereof. During this pivoting motion, the upper thread 4 slides up, along and over the leading surface 27 of the stop boss 12, moves down and beyond the trailing surface 26 and arrives at and is cut by the cutting means or cutting blade 11. As the gripper neck 8 moves past the needle 3, the upper thread 4 is tensioned somewhat and, thus, is reliably cut by the cutting means or cutting blade 11. Thus, during normal gripper sewing operation, the upper thread 4 may slide somewhat along the leading edge 27 of the stop boss 12, but will not move therebeyond and will be stopped by the leading edge 27, again during the predetermined distance moved from the solid outline position of the gripper 7 to the dashed phantom outline position 13 thereof. In this manner by selectively driving the gripper shaft 6, the upper thread 4 can simply be stitched (phantom outline dashed position 13) or cut (phantom outline dot-dashed position 14).

Figure 2:
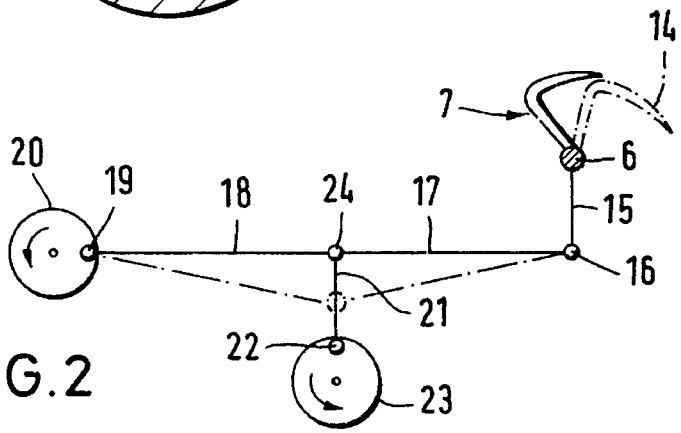
FIG. 2 is a highly schematic view of a drive mechanism for the gripper shaft of FIG. 1, and illustrates various links, levers and cams associated therewith.

Reference is made to FIG. 2 of the drawings in which a drive and control mechanism or system is provided for controlling the selective rotation of the gripper shaft 6. Essentially the gripper shaft 6 is conventionally held in pivot bearings and lever arm 15 is connected thereto and is in turn part of an articulated connection means 16 linked to lever arms 17 and 18 pivoted together by a pivot or hinge 24. A pivot pin 19 connects the lever arm 18 to a peripheral edge of a cam 20 rotated about its axis (unnumbered). A further lever arm 21 is connected to the pivot pin or hinge 24 and to a pivot 22 at a periphery of a cam 23 also rotated about its fixed axis (unnumbered).

During normal sewing, when the cutting blade or cutting means 11 is inoperative and the gripper 7 rocks or reciprocates only between the solid line position and the dashed phantom outlined position 13 of FIG. 1, the lever arms 18, 17 and 15 and the revolving cam or arm 20 implements the pivoting motion of the gripper 7 through the latter-defined predetermined distance. However, when the gripper 7 must be pivoted or rocked further into the dot-dashed phantom outlined position 14 to cut-off the upper thread 4, the revolving cam 20 operates in conjunction with the cam 23 such that the pivot 22 arrives at the lower cam position and the levers 17, 18 are moved by the lever arm 21 into the dot-dashed position of FIG. 2. In this position, the lever arm 15 is pivoted clockwise further about the gripper shaft 6 than during normal sewing, and thus the gripper shaft 6 will be rocked between the solid position of the gripper 7 shown in FIG. 1 and the dot-dashed phantom outline position 14 thereof resulting in the upper thread 4 being cut-off.

Although a preferred embodiment of the invention has been specifically illustrated and described herein, it is to be understood that minor variations may be made in the apparatus without departing from the spirit and scope of the invention, as defined the appended claims.

I claim:

1. An improvement in a sewing machine which includes a sewing needle carrying a thread which is selectively cut-off during a sewing operation comprising a gripper (7), said gripper (7) having means (11) for cutting-off a thread in response to a gripper motion, means for imparting motion to said gripper (7) to selectively (a) move said gripper (7) a predetermined distance through which said cutting-off means (11) is inoperative and (b) move said gripper (7) a further distance beyond said predetermined distance through which said cutting-off means (11) is operative to cut-off a thread, and said gripper (7) including means (12) for preventing the cutting-off of the thread upon the operation of said motion-imparting means during movement of said gripper (7) said predetermined distance.

2. The sewing machine improvement as defined in claim 1 wherein said gripper (7) is defined by a gripper neck (8) joined by a gripper bend (25) to a gripper hook (9), and said cutting means (11) is located substantially adjacent said gripper bend (25).

3. The sewing machine improvement as defined in claim 1 wherein said gripper (7) is defined by a gripper neck (8) joined by a gripper bend (25) to a gripper hook (9), and said cutting means (11) is located substantially contiguous said gripper bend (25).

4. The sewing machine as defined in claim 1 wherein said motion-imparting means includes cam linkage and lever means (15–23( for imparting said selective motion to said gripper (7).

5. An improvement in a sewing machine which includes a sewing needle carrying a thread which is selectively cut-off during a sewing operation comprising a gripper (7), said gripper (7) having means (11) for cutting-off a thread in response to a gripper motion, means for imparting motion to said gripper (7) to selectively (a) move said gripper (7) a predetermined distance through which said cutting-off means (11) is inoperative and (b) move said gripper (7) a further distance beyond said predetermined distance through which said cutting-off means (11) is operative to cut-off a thread, said gripper (7) is defined by a gripper neck (8) joined by a gripper bend (25) to a gripper hook (9), said cutting means (11) being located substantially adjacent said gripper bend (25), and said gripper (7) including means (12) for preventing the cutting-off of the thread upon the operation of said motion-imparting means during movement of said gripper (7) said predetermined distance.

6. The sewing machine as defined in claim 5 wherein said gripper (7) includes a free terminal end of said gripper hook (9), and said cutting-off preventing means (12) is located more adjacent said free terminal end than said thread cutting-off means (11).

7. An improvement in a sewing machine which includes a sewing needle carrying a thread which is selectively cut-off during a sewing operation comprising a gripper (7), said gripper (7) having means (11) for cutting-off a thread in response to a gripper motion, means for imparting motion to said gripper (7) to selectively (a) move said gripper (7) a predetermined distance through which said cutting-off means (11) is inoperative and (b) move said gripper (7) a further distance beyond said predetermined distance through which said cutting-off means (11) is operative to cut-off a thread, said gripper (7) is defined by a gripper neck (8) joined by a gripper bend (25) to a gripper hook (9), said cutting means (11) being located substantially contiguous said gripper bend (25), and said gripper (7) including means (12) for preventing the cutting-off of the thread upon the operation of said motion-imparting means during movement of said gripper (7) said predetermined distance.

8. The sewing machine as defined in claim 7 wherein said gripper (7) includes a free terminal end of said gripper hook (9), and said cutting-off preventing means (12) is located more adjacent said free terminal end than said thread cutting-off means (11).

9. The sewing machine as defined in claim 6 wherein said motion-imparting means includes cam linkage and lever means (15–23) for imparting said selective motion to said gripper (7).

10. The sewing machine as defined in claim 8 wherein said motion-imparting means includes cam linkage and lever means (15–23) for imparting said selective motion to said gripper (7).

11. The sewing machine improvement as defined in claim 1 wherein said gripper motion imparting means imparts reciprocal pivoting motion to said gripper (7).

12. The sewing machine improvement as defined in claim 4 wherein said gripper motion imparting means imparts reciprocal pivoting motion to said gripper (7).

13. The sewing machine improvement as defined in claim 5 wherein said gripper motion imparting means imparts reciprocal pivoting motion to said gripper (7).

14. The sewing machine improvement as defined in claim 7 wherein said gripper motion imparting means imparts reciprocal pivoting motion to said gripper (7).

15. The sewing machine improvement as defined in claim 6 wherein said gripper motion imparting means imparts reciprocal pivoting motion to said gripper (7).

16. The sewing machine improvement as defined in claim 8 wherein said gripper motion imparting means imparts reciprocal pivoting motion to said gripper (7).

17. The sewing machine improvement as defined in claim 9 wherein said gripper motion imparting means imparts reciprocal pivoting motion to said gripper (7).

18. The sewing machine improvement as defined in claim 10 wherein said gripper motion imparting means imparts reciprocal pivoting motion to said gripper (7).

* * * * *